United States Patent [19]

Usami et al.

[11] Patent Number: 4,650,740

[45] Date of Patent: Mar. 17, 1987

[54] HEAT-SENSITIVE RECORDING MATERIAL

[75] Inventors: Toshimasa Usami; Toshiharu Tanaka; Fumiaki Shinozaki, all of Shizuoka, Japan

[73] Assignee: Fuji Photo Film Co., Ltd., Kanagawa, Japan

[21] Appl. No.: 650,143

[22] Filed: Sep. 13, 1984

[30] Foreign Application Priority Data

Sep. 13, 1983 [JP] Japan ..... 58-169015

[51] Int. Cl.[4] ..... G03C 1/54; G03C 1/58; G03C 1/60

[52] U.S. Cl. ..... 430/176; 430/163; 430/171; 430/177; 430/179; 430/180; 430/182; 534/556; 534/558; 534/559; 534/560; 346/135.1; 346/200; 346/216; 346/217

[58] Field of Search ..... 430/163, 151, 176, 175, 430/171, 177, 179; 534/556, 559, 558, 560; 346/135.1, 200, 216, 217

[56] References Cited

U.S. PATENT DOCUMENTS

| | | | |
|---|---|---|---|
| 3,281,244 | 10/1966 | Endermann et al. | 430/151 |
| 3,679,419 | 7/1972 | Gillich | 430/175 |
| 3,997,349 | 12/1976 | Sanders | 430/163 |
| 4,039,521 | 8/1977 | Smith | 430/163 |
| 4,387,150 | 6/1983 | Yabuta et al. | 430/151 |
| 4,403,028 | 9/1983 | Mustacchi et al. | 430/163 |
| 4,411,979 | 10/1983 | Nagamoto et al. | 430/176 |
| 4,482,489 | 11/1984 | DiPippo | 430/163 |

*Primary Examiner*—Charles L. Bowers, Jr.
*Attorney, Agent, or Firm*—Sughrue, Mion, Zinn, Macpeak & Seas

[57] ABSTRACT

A heat-sensitive recording material is described, comprising a support having provided thereon a recording layer comprising a binder containing a diazonium compound and a coupling component, said diazonium compound being a diazonium salt represented by formula (I)

$$ArN_2^+X^- \quad (I)$$

wherein Ar represents a substituted or unsubstituted aromatic moiety; and $X^-$ represents an acid anion containing an alkyl group having three or more fluorine atoms.

16 Claims, No Drawings

HEAT-SENSITIVE RECORDING MATERIAL

FIELD OF THE INVENTION

This invention relates to a heat-sensitive recording material, and particularly to a diazonium heat-sensitive recording material capable of being fixed. Still more particularly, it pertains to a heat-sensitive recording material which has an excellent storage properties prior to thermal recording, which provides high coloration density upon thermal recording, and which can be fixed by light after thermal recording.

BACKGROUND OF THE INVENTION

Heat-sensitive recording methods have recently been increasingly used in the fields of facsimile and printers, due to advantages such as:

(1) no development step is required;
(2) paper quality is approximately that of ordinary paper when paper is used as the support;
(3) handling is easy;
(4) high coloration density is obtained;
(5) recording equipment therefor is simple and inexpensive; and
(6) no noise is produced upon recording.

As heat-sensitive recording materials for such methoods, leuco coloration type heat-sensitive recording materials excellent in coloration density and coloration rate are predominantly used. However, leuco coloration type heat-sensitive recording materials have certain defects, in that (1) they can form color by handling after recording, (2) by heat, (3) by adhesion of a solvent to stain recording images, and (4) the formed color is removed by plasticizer contained in cellophane tapes.

In order to prevent coloration caused by careless handling, it has been known to add a particulate wax as disclosed in Japanese Patent Publication No. 14531/75 or to provide a coating layer for preventing permeation of the plasticizer as disclosed in Japanese Utility Model Application (OPI) No. 125354/81 (the term "OPI" as used herein refers to a "published unexamined Japanese Application"). However, these techniques are still unsatisfactory, and, where the possibility of falsification must be avoided, heat-sensitive recording materials have not been used. Thus, it has been eagerly desired to improve them. As a technique of preventing coloration in undesired portions after themal recording, it has been known to use a heat-sensitive recording material comprising a diazonium compound, a coupling component, an alkali-producing agent, or a coloration aid, and, after thermal recording, irradiate the material with light to decompose unreacted diazonium compound for the purpose of stopping further coloration, as disclosed in Japanese Patent Application (OPI) Nos. 123086/82, 125092/82 (corresponding to U.S. Pat. No. 4,411,979), U.S. Pat. No. 3,281,244, etc.

However, this recording material has the defect that it can undergo gradual pre-coupling during storage to produce unfavorable coloration (fog). Therefore, at least one of the color-forming components is allowed to exist in the form of non-continuous particles (i.e., a solid dispersion) to prevent the components from contacting with each other, thereby preventing precoupling. However, shelf storage properties of such recording material are still insufficient.

As another technique, it is known to separate the diazonium compound and the coupling component from each other by incorporating them in different layers for minimizing the contact therebetween. This technique improves shelf storage stability, but it concurrently so deteriorates thermal coloration properties that the material based on this technique fails to respond to high-speed recording with short pulse width.

Further, it is known to encapsulate either a coupling component or an alkali component with a non-polar wax substance (Japanese Patent Application (OPI) Nos. 4414/82 and 142636/82) or with a hydrophobic high molecular weight substance (Japanese Patent Application No. 192944/82) for separating it from the other component.

This encapsulating technique involves complicated steps of dissolving the wax or high molecular substance in a solvent, dissolving or dispersing the color-forming component in the resulting solution, then evaporating off the solvent to form microcapsules.

These techniques have attempted to overcome the fundamental fact that diazonium compounds possess a considerable solubility in water, but, in many cases, high-speed printability is sacrificed for the sake of improving shelf storage properties of heat-sensitive recording materials.

SUMMARY OF THE INVENTION

It is, therefore, an object of the present invention to provide a heat-sensitive recording material which shows a high coloration speed and a high coloration density, and which has an excellent shelf storage properties and scarcely undergoes increased fogging under typical temperature and humidity conditions.

Another object of the present invention is to provide a heat-sensitive recording material which enables prevention of coloration in undesired portions (hereinafter referred to as fixing) by photodecomposing unreacted diazonium compound after thermal recording.

A further object of the present invention is to provide a heat-sensitive material with excellent production adaptability.

Still a further object of the present invention is to provide a heat-sensitive recording material which, after decomposition of diazonium compound in exposed portions by photorecording, forms a visible image by heating, to thereby form color in unexposed portions.

Still a further object of the present invention is to provide a heat-sensitive recording material which has excellent shelf storage properties and which can be produced without a complicated step of encapsulating diazonium compound.

This invention is a heat-sensitive recording material comprising a support having provided thereon a recording layer comprising a binding containing a diazonium compound and a coupling component, said diazonium compound being a diazonium salt represented by formula (I)

$$ArN^{+}{}_{2}X^{-} \qquad (I)$$

wherein Ar represents a substituted or unsubstituted aromatic moiety; and $X^-$ represents an acid anion containing an alkyl group having 3 or more fluorine atoms.

DETAILED DESCRIPTION OF THE INVENTION

This diazonium compound can maintain its properties and avoid undergoing an increase in fog even in a solid dispersed state.

The diazonium compounds of the present invention are described in more detail below.

The aromatic moiety represented by Ar is, preferably, represented by formula (II)

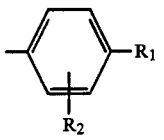

(II)

wherein $R_1$ represents a hydrogen atom, a substituted amino group, an alkoxy group having from 1 to 18 carbon atoms, an aryloxy group having from 6 to 18 carbon atoms, an alkylthio group having from 1 to 18 carbon atoms, an arylthio group having from 6 to 18 carbon atoms, an arylamino group having from 6 to 18 carbon atoms, or an acylamino group having from 1 to 18 carbon atoms; said substituted amino group preferably including a dialkylamino group having from 1 to 36 carbon atoms, an arylamino group having from 6 to 18 carbon atoms, a morpholino group, a piperidino group, a pyrrolidino group, etc., and $R_2$ represents a hydrogen atom, an alkyl group having from 1 to 5 carbon atoms, a halogen atom (e.g., I, Br, Cl, F), an alkoxy group having from 1 to 18 carbon atoms, an aryloxy group having from 6 to 18 carbon atoms, or an arylamino group having from 1 to 18 carbon atoms.

Specific examples of the diazonium forming salts are 4-diazo-1-dimethylaminobenzene, 4-diazo-1-diethylaminobenzene, 4-diazo-1-dipropylaminobenzene, 4-diazo-1-dibenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-anilinobenzene, 4-diazo-1-toluylmercapto-2,5-diethoxybenzene, 4-diazo-1,4-methoxybenzoylamino-2,5-diethoxybenzene, etc.

$X^-$ represents an acid anion containing an alkyl group having 3 or more fluorine atoms, with the number of fluorine atoms preferably being 9 or more. The alkyl group includes unsaturated alkyl groups such as alkenyl groups. The number of carbon atoms of the alkyl group is preferably 20 or less.

The acid anion represented by $X^-$ is preferably represented by formula (III)

$$Y—Z—W^- \quad \text{(III)}$$

wherein Y represents a fluorine-containing alkyl group, such that when Y is a saturated fluorine-containing alkyl group, Y is specifically represented by formula (IV)

$$C_nH_mF_{2n-m+1}^- \quad \text{(IV)}$$

(wherein n represents an integer of 1 to 18, and m represents an integer of 0 to 2n−2, preferably 9 or more fluorine atoms), and such that when Y is an unsaturated fluorine-containing alkyl group, Y is represented by formula (V)

$$C_nH_mF_{2n-m-1}^- \quad \text{(V)}$$

(wherein n represents an integer of 2 to 18, and m represents an integer of 0 to 2n−4, preferably 9 or more fluorine atoms);

Z represents a linkage connecting Y and $W^-$ to each other directly or through a divalent linking group (as the divalent group, various such groups known in the field of organic chemistry can be used and this invention is not limited to specific groups; examples include —O—, —S—, $—OCH_2CH_2—$,

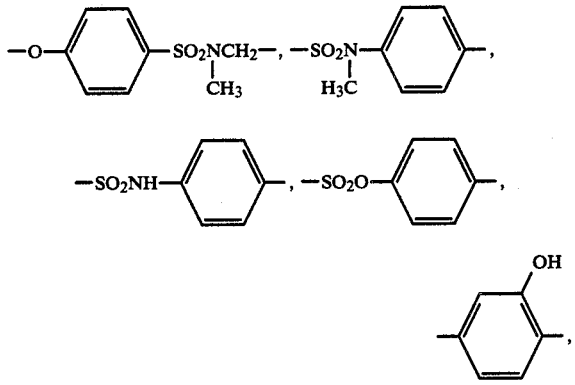

$—SO_2N(C_2H_5)C_2H_4O—$, etc.); and $W^-$ represents an ion moiety such as $COO^-$, $SO_3^-$ or $PO_4^-$.

Specific examples of diazonium compounds (diazonium salts) according to formula (I) are set forth below.

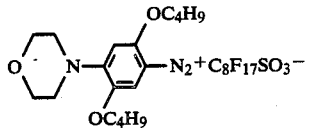

(1)

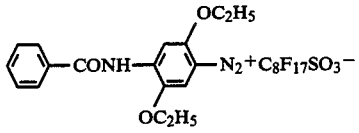

(2)

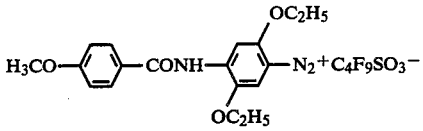

(3)

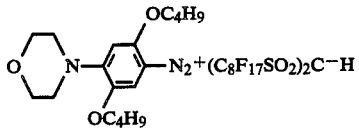

(4)

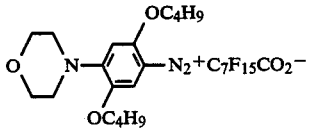

(5)

-continued (6)

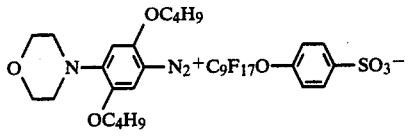

(7)

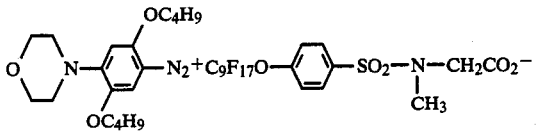

The coupling component to be used in the present invention is a compound which couples with a diazo compound in a basic environment to form a dye. Specific examples thereof include 2-hydroxy-3-naphthoic acid anilide, 1-hydroxy-2-naphthoic acid morpholinopropylamide, 2-hydroxy-3-naphthoic acid morpholinopropylamide, 2-hydroxy-3-naphthoic acid-2'-methylanilide, 2-hydroxy-3-naphthoic acid octylamide, 2-hydroxy-3-naphthoic acid N-dodecyloxypropylamide, 1-phenyl-3-methyl-5-pyrazolone, etc.

In the present invention, it is preferable to incorporate a substance that becomes a basic compound by heat (basic substance). Examples of the basic substance include triphenylguanidine, diphenyl-o-tolylguanidine, diphenyl-p-tolylguanidine, 2-benzylimidazole, 4-phenylimidazole, 2-phenyl-4-methylimidazole, 2-undecylimidazoline, 4,4'-dithiomorpholine, 2-aminobenzothiazole, and 2-benzoylhydrazinobenzothiazole.

These diazonium compound, coupling component, and basic substance may be used in combinations of two or more.

As a stabilizing agent to be used in the present invention, those substances which are used for ordinary diazonium type copying papers may be used. Specific examples thereof include phosphoric acid, boric acid, tartaric acid, citric acid, salicyclic acid, palmitic acid, thiourea, urea, ammonium salicylate, ammonium carbonate, etc.

As a melting point-reducing agent, known substances may be used. Specific examples thereof include an alcohol derivative, a wax, a polyhydric alcohol ester of higher fatty acid, amides, a metal salt of higher fatty acid, a higher straight chain glycol, etc.

The heat-sensitive recording material of the present invention can be obtained in a manner as described in, for example, U.S. Pat. No. 4,387,150 . That is, a diazonium compound, a coupling component, and a basic substance are separately, or, if desired, simultaneously milled into particles of several microns or less in a binder of a suitable concentration using a mill such as ball mill. Proper amounts of the resulting dispersions were mixed, and a stabilizing acid, an antioxidant, and a melting point-reducing agent are properly added thereto. Then, the resulting mixture is coated on a support to prepare a heat-sensitive paper capable of being fixed.

As to be preferred amounts to be employed, the coupling component is used in an amount of from 0.1 to 10 parts by weight, and the basic substance is used in an amount of from 0.1 to 20 parts by weight, per part by weight of the diazonium compound. The diazonium compound is preferably coated so that the amount in the recording layer is from 0.05 to 2.0 g/m$^2$. The binder is coated preferably such that the amount (solids) in the recording layer is from 0.5 to 5 g/m$^2$.

As the binder, polyvinyl alcohol, methyl cellulose, carboxymethyl cellulose, hydroxymethyl cellulose, gum arabic, gelatin, casein, styrene-maleic anhydride copolymer, polyacrylamide, etc., can be used.

As the support, paper is generally used, but synthetic resin film, laminated paper, etc., are also usable.

The present invention will now be described in more detail by reference to examples and comparative examples. However, the invention is not limited to these examples.

EXAMPLE 1

(1) Preparation of a Solid Dispersion of Diazonium Compound

| | |
|---|---|
| 5% Polyvinyl Alcohol | 100 g |
| Diazonium Salt of the Following Formula: | 10 g |

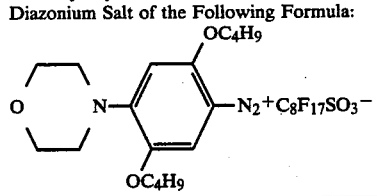

The above-described composition was milled in a ball mill for 24 hours to form a dispersion. The mean particle size was 1.5$\mu$.

(2) Preparation of a Solid Dispersion of Coupling Component

| | |
|---|---|
| 4% Polyvinyl Alcohol | 100 g |
| Naphthol As | 20 g |

The above-described composition was milled in a ball mill for 24 hours to form a dispersion. The mean particle size was 2$\mu$.

(3) Preparation of a Solid Dispersion of Basic Substance

| | |
|---|---|
| 4% Polyvinyl Alcohol | 100 g |
| Triphenylguanidine | 20 g |

The above-described composition was milled for 24 hours in a ball mill to form a dispersion. The mean particle size was 2$\mu$.

(4) Preparation of a Coating Solution for Forming a Heat-Sensitive Layer

| | |
|---|---|
| Tartaric Acid | 0.1 g |
| Ethylthiourea | 0.2 g |
| Diazonium Compound Solid Dispersion (1) | 2 g |
| Coupling Component Solid Dispersion (2) | 4 g |
| Basic Substance Solid Dispersion (3) | 4 g |
| 5% Polyvinyl Alcohol | 2 g |

The above-described composition was coated in a dry amount of 5.5 g/m$^2$.

EXAMPLE 2

A heat-sensitive paper was prepared in the same manner as in Example 1 except for using, as a diazonium compound in (1) of Example 1, the following diazonium compound:

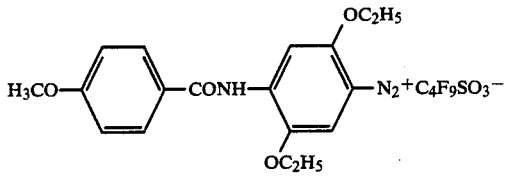

EXAMPLE 3

A heat-sensitive paper was prepared in the same manner as in Example 1 except for using, as a diazonium compound in (1) of Example 1, the following diazonium compound:

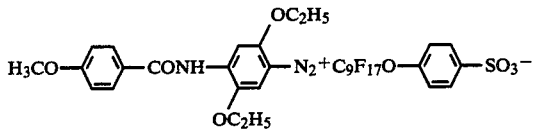

COMPARATIVE EXAMPLE 1

A heat-sensitive paper was prepared in the same manner as in Example 1 except for using, as a diazonium compound in (1) of Example 1, the following diazonium compound:

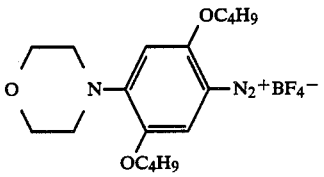

COMPARATIVE EXAMPLE 2

A heat-sensitive paper was prepared in the same manner as in Example 1 except for using, as a diazonium compound in (1) of Example 1, the following diazonium compound:

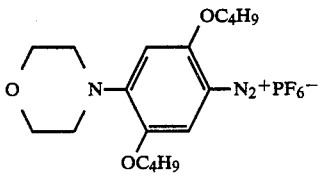

The thus-prepared heat-sensitive recording papers were heat-printed using Mitsubishi Melfas Printer 600 (mode GIII; made by Mitsubishi Electric Corp.) and fixed by uniform exposure using Ricoh Hi-Start Model 4 (made by Ricoh Company Ltd.). Blue densities of the thus-obtained recorded images were measured by means of a Macbeth reflection densitometer. The background of each of the fixed samples was heated to 150° C. to examine whether it again formed a blue color or not (fixing properties). Then, for examining shelf storage properties, each sample was stored for 7 days in dark room under incubating conditions of 30° C. and 75% RH, followed by measuring background density (fog) after the incubation by means of a Macbeth reflection densitometer to check for the change in fog as compared to before the incubation.

The results thus obtained are tabulated in Table 1.

TABLE 1

| Heat-Sensitive Recording Paper | Fog Density | | Density of Printed Letter | Fixing Properties |
|---|---|---|---|---|
| | Before Incubation | After Incubation | | |
| Example 1 | 0.10 | 0.18 | 1.21 | Good |
| Example 2 | 0.09 | 0.16 | 1.14 | Good |
| Example 3 | 0.09 | 0.15 | 1.17 | Good |
| Comparative Example 1 | 0.26 | 0.73 | 1.26 | Good |
| Comparative Example 2 | 0.25 | 0.48 | 1.25 | Good |

As is described above, the use of the diazonium compounds of the present invention enabled obtained heat-sensitive recording material having good storage properties, which attain high coloration density, and which are able to be fixed.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having provided thereon a recording layer, wherein said recording layer comprises, in admixture: a binder, a diazonium compound, a coupling component and a basic substance, wherein said diazonium compound is a diazonium salt represented by formula (I)

$$ArN_2^+X^- \quad (I)$$

wherein Ar represents a substituted or unsubstituted aromatic moiety; and $X^-$ represents an acid anion containing an alkyl group having 4 or more carbon atoms and three or more fluorine atoms, wherein said acid anion is selected from the group consisting of $COO^-$, $SO_3^-$ and $PO_4^-$, wherein said diazonium compound is present in the recording layer in an amount from 0.05 to 2.0 g/m$^2$, when said binder is present in an amount of from 0.5 to 5 g/m$^2$, wherein said coupling component is present in an amount of from 0.1 to 10 parts by weight per part by weight of said diazonium compound and, wherein said basic substance is present in an amount of from 0.1 to 20 parts by weight per part by weight of said diazonium compound.

2. A heat-sensitive recording material as in claim 1, wherein the aromatic moiety represented by Ar is represented by formula (II)

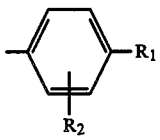

(II)

wherein $R_1$ represents a hydrogen atom, a substituted amino group, an alkoxy group having from 1 to 18 carbon atoms, an aryloxy group having from 6 to 18 carbon atoms, an alkylthio group having from 1 to 18 carbon atoms, an arylthio group having from 6 to 18 carbon atoms, an arylamino group having from 6 to 18 carbon atoms, or an acylamino group having from 1 to 18 carbon atoms; said substituted amino group including a dialkylamino group having from 1 to 36 carbon atoms, an arylamino group having from 6 to 18 carbon atoms, a morpholino group, a piperidino group, a pyrrolidino group; and $R_2$ represents a hydrogen atom, an alkyl group having from 1 to 5 carbon atoms, a halogen atom, an alkoxy group having from 1 to 18 carbon atoms, an aryloxy group having from 6 to 18 carbon atoms, or an arylamino group having from 1 to 18 carbon atoms.

3. A heat-sensitive recording material as in claim 1, wherein $X^-$ represents an acid anion containing an alkyl group having 4 to 20 carbon atoms.

4. A heat-sensitive recording material as in claim 2, wherein $X^-$ represents an acid anion containing an alkyl group having 4 to 20 carbon atoms.

5. A heat-sensitive recording material as in claim 1, wherein the acid anion represented by $X^-$ is represented by formula (III)

$$Y—Z—W^- \quad \text{(III)}$$

wherein Y represents a saturated fluorine-containing alkyl group represented by formula (IV)

$$C_nH_mF_{2n-m+1}^- \quad \text{(IV)}$$

wherein n represents an integer of 4 to 18, and m represents an integer of 0 to 2n−2; Z represents a linkage connecting Y and $W^-$ to each other directly or through a divalent linking group; and $W^-$ *represents an anion moiety.*

6. A heat-sensitive recording material as in claim 2, wherein the acid anion represented by $X^-$ is represented by formula (III)

$$Y—Z—W^- \quad \text{(III)}$$

wherein Y representes a saturated fluorine-containing alkyl group represented by formula (IV)

$$C_nH_mF_{2n-m+1}^- \quad \text{(IV)}$$

wherein n represents an integer of 4 to 18, and m represents an integer of 0 to 2n−2; Z represents a linkage connecting Y and $W^-$ to each other directly or through a divalent linking group; and $W^-$ represents an anion moiety.

7. A heat-sensitive recording material as in claim 1, wherein the acid anion represented by $X^-$ is represented by formula (III)

$$Y—Z—W^- \quad \text{(III)}$$

wherein Y represents an unsaturated fluorine-containing alkyl group represented by formula (V)

$$C_nH_mF_{2n-m-1}^- \quad \text{(V)}$$

wherein n represents an integer of 4 to 18, and m represents an integer of 0 to 2n−4; Z represents a linkage connecting Y and $W^-$ to each other directly or through a divalent linking group; and $W^-$ represents an anion moiety.

8. A heat-sensitive recording material as in claim 2, wherein the acid anion represented by $X^-$ is represented by formula (III)

$$Y—Z—W^- \quad \text{(III)}$$

wherein Y represents an unsaturated fluorine-containing alkyl group represented by formula (V)

$$C_nH_mF_{2n-m-1}^- \quad \text{(V)}$$

wherein n represents an integer of 4 to 18, and m represents an integer of 0 to 2n−4; Z represents a linkage connecting Y and $W^-$ to each other directly or through a divalent linking group; and $W^-$ represents an anion moiety.

9. A heat-sensitive recording material as in claim 5, wherein $X^-$ has 9 or more fluorine atoms.

10. A heat-sensitive recording material as in claim 6, wherein $X^-$ has 9 or more fluorine atoms.

11. A heat-sensitive recording material as in claim 7, wherein $X^-$ has 9 or more fluorine atoms.

12. A heat-sensitive recording material as in claim 8, wherein $X^-$ has 9 or more fluorine atoms.

13. A heat-sensitive recording material as in claim 1, wherein the coupling component is selected from the group consisting of 2-hydroxy-3-naphthoic acid anilide, 1-hydroxy-2-naphthoic acid morpholinopropylamide, 2-hydroxy-3-naphthoic acid morpholinopropylamide, 2-hydroxy-3-naphthoic acid-2'-methylanilide, 2-hydroxy-3-naphthoic acid octylamide, 2-hydroxy-3-naphthoic acid N-dodecyloxypropylamide and 1-phenyl-3-methyl-5-pyrazolone.

14. A heat-sensitive recording material as in claim 1, wherein the binder is selected from the group consisting of polyvinyl alcohol, methyl cellulose, carboxymethyl cellulose, hydroxymethyl cellulose, gum arabic, gelatin, casein, styrene-maleic anhydride copolymer and polyacrylamide.

15. A heat-sensitive recording material as in claim 1, wherein the basic substance is selected from the group consisting of triphenylguanidine, diphenyl-o-tolylguanidine, diphenyl-p-tolylguanidine, 2-benzylimidazole, 4-phenylimidazole, 2-phenyl-4-methylimidazole, 2-undecylimidazoline, 4,4'-dithiomorpholine, 2-aminobenzothiazole and 2-benzoylhydrazinobenzothiazole.

16. A heat-sensitive recording material as in claim 2, wherein the basic substance is selected from the group consisting of triphenylguanidine, diphenyl-o-tolylguanidine, diphenyl-p-tolylguanidine, 2-benzylimidazole, 4-phenylimidazole, 2-phenyl-4-methylimidazole, 2-undecylimidazoline, 4,4'-dithiomorpholine, 2-aminobenzothiazole and 2-benzoylhydrazinobenzothiazole.

* * * * *